United States Patent [19]

Stroomer et al.

[11] Patent Number: 4,740,785

[45] Date of Patent: Apr. 26, 1988

[54] ELECTROSCOPIC PICTURE DISPLAY DEVICE HAVING SELECTIVE DISPLAY OF LOCAL INFORMATION

[75] Inventors: Martinus V. C. Stroomer; Henricus F. A. de Leeuw, both of Eindhoven, Netherlands

[73] Assignee: U.S. Philips Corp., New York, N.Y.

[21] Appl. No.: 776,720

[22] Filed: Sep. 16, 1985

[30] Foreign Application Priority Data

Sep. 27, 1984 [NL] Netherlands ..... 8402937

[51] Int. Cl.[4] ..... G09G 3/34

[52] U.S. Cl. ..... 340/783; 340/764; 340/788; 340/805; 350/269; 350/486

[58] Field of Search ..... 340/763, 764, 775, 783, 340/788, 815.05, 815.27, 805; 350/269, 486

[56] References Cited

U.S. PATENT DOCUMENTS

| | | | |
|---|---|---|---|
| 3,520,357 | 5/1975 | Castleberry et al. | 340/783 |
| 4,206,369 | 6/1980 | Lewiner et al. | 340/783 |
| 4,519,676 | 5/1985 | te Velde | 340/763 |
| 4,571,585 | 2/1986 | Stein et al. | 340/805 |

*Primary Examiner*—Gerald L. Brigance
*Assistant Examiner*—Jeffery A. Brier
*Attorney, Agent, or Firm*—Paul R. Miller

[57] ABSTRACT

Such a device comprises display elements (RC) arranged, for example, in matrix form in rows and columns with, each display element comprising a first (E1) and a second electrode (E2) and an intermediate, movable, third electrode (E3). The first electrode (E1) is used in common by the elements (RC) with, the second electrode (E2) forming part of a strip-shaped row electrode and the third electrodes (E3) having an electrical through-connection in the column direction. Depending on the polarities of information pulses applied to the electrodes by a control voltage source, the third electrode is positioned adjacent the first or second electrode to achieve a bright or a dark picture element on display. With picture element-selective drive by a row selection with, a change being made for the selected picture element from the bright to the dark state, a non-energized state occurs at the other bright and dark picture elements in the column. To counteract the possibility of picture disturbance, a pulse (CT2) is simultaneously applied, in addition to the information pulses (CT1), to each electrode with a polarity which is the same for the first and the second electrodes and is the opposite for the third electrode. This results in a reset with a memory state.

4 Claims, 3 Drawing Sheets

Figure 1A:
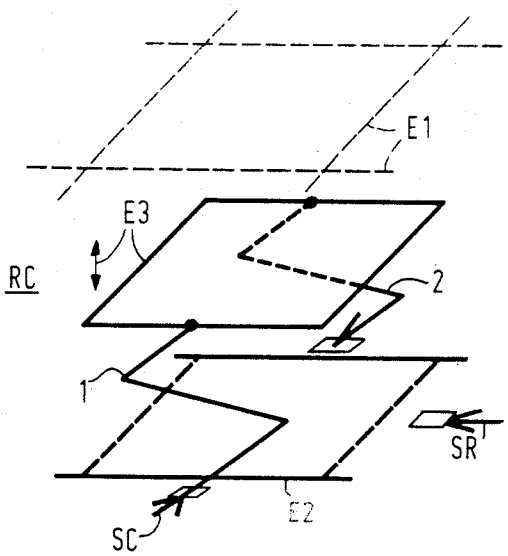

ELECTROSCOPIC PICTURE DISPLAY DEVICE HAVING SELECTIVE DISPLAY OF LOCAL INFORMATION

The invention relates to an electroscopic picture display comprising display elements arranged in the form of a matrix and each comprising first and second electrodes and an intermediate, movable third electrode with the first electrode being an electrode used in common by the display elements, and with the second and third electrodes of the display elements having electric through-connections located for the second and third electrodes in directions which intersect each other. The display device comprises a control voltage source for applying, at least during an information supply period, control pulses to the electrodes with the third electrode being located after the supply of information near the first or the second electrode depending on the polarity of the control pulse voltage at the third electrode of a display element relative to the control pulse voltage at the first and second electrodes, which polarities are in anti-phase.

Such a picture display device is disclosed in European patent application Ser. No. 0,085,459 corresponding to U.S. Pat. No. 4,519,676. The movable third electrodes are disposed in an opaque liquid and are each coupled to a supporting surface by resilient components, there being, by way of example, electric interconnections in a column direction. In this situation the second electrodes are arranged in rows in the form of strips on the supporting surface. The movable third electrodes have reflecting surfaces and are located as intermediate electrodes between the common first top electrode, which is transparent, and the strip-shaped second bottom electrodes. In the described structure the electroscopic picture display device operates with reflected ambient light. Instead of reflection, light transmission through the display elements may also be utilized in a known manner for the display of information.

During the supply of information to the display elements, control clock pulses are applied t the rows or columns of the electrodes for a sequential selection thereof. During a row or a column selection clock pulse, control clock pulses associated with the information component to be displayed are applied sequentially or simultaneously to the columns or rows of electrodes. It is clear that during the supply of information to a display element located at a row-column intersection of electrodes, the second and third electrode respectively receive a selection clock pulse and the third and second electrode respectively receive an information clock pulse.

If prior to the supply of information to the display elements, all the movable electrodes are located near the strip-shaped bottom electrodes, that is to say near the column-row intersection of these electrodes, the supply of information can be effected without problems, such as, during the cross-section selection-and-supply of information, when a clock pulse is applied to the movable intermediate electrode which is in anti-phase and in phase respectively with the clock pulse at the strip-shaped bottom electrode, the intermediate electrode will remain where it was or move to the common top electrode (at which an anti-phase clock pulse is present). In principle there should be no crosstalk from the selected to the non-selected display elements.

If thereafter one wants to move a single intermediate electrode, located near the common top electrode, to the strip-shaped bottom electrode problems may occur. For control based on bottom electrode-row selection and intermediate electrode-column information supply, given by way of example, the other intermediate electrodes of the same column will be adjusted to a non-energized state. This non-energized state occurs at the points of intersection of the non-selected bottom electrodes and the intermediate electrode column to which the shift information from top to bottom electrodes is applied, while the intermediate electrodes at these intersections are located near the top electrode or near the bottom electrode and must stay there. In the non-energized state all three electrodes have a control pulse voltage of the same phase. During this non-energized state the relevant intermediate electrodes will move to an equilibrium position, which is unwanted because it would disturb the displayed information.

The problem described in the foregoing can be solved by erasing the displayed information prior to each supply of information.

The invention has for its object to provide an electroscopic picture display device in which prior to the supply of information to a picture element (moving the intermediate electrode from top to bottom) no previous general erasure of displayed information is required, and said local supply of information can be effected selectively.

According to the invention, an electroscopic picture display device, is characterized in that during the information supply period, the control voltage source, in addition to applying the control pulses for the information supply to a display element, also supplies simultaneously to each of the three electrodes of the display elements a pulse of one polarity for the first and second electrodes and of opposite polarity for the third electrode.

The three simultaneous pulses with the above-mentioned polarities ensure that the non-energized state or states is/are followed by a reset pulse with a memory state. The possible time difference between the occurrence of the non-energized state and the resetting operation depends on the specific structure of the display elements. The reset instant should occur before the disturbance in the displayed information becomes noticeable, which depends on the rate of movement of the intermediate electrodes during the non-energized state.

An embodiment of an electroscopic picture display device according to the invention, in which independent of the specific structure of the display elements the local supply of information can occur selectively, is characterized in that during the period in which information is supplied the control voltage source applies the pulses with the relevant polarities to a display element after each control pulse for the information supply.

In this situation the supply of information to a display element always requires two clockpulse periods which are equal or not equal with a local selection and information supply occurring during the first period and no selection during the second period and all display elements being submitted to the reset with a memory state. Each non-energized state is immediately followed by a reset. For a desired brief supply of information the second clock pulse periods for the reset can be significantly shorter than the first clock pulse periods.

A simple construction of an electroscopic picture display device according to the invention, is characterized in that the control voltage source comprises a program generator coupled to an addressable memory with separate memory locations, coupled to an address generator for the memory, coupled to a timing signal generator, and coupled to a display element selection control circuit with a display element information control circuit being coupled to an output of the memory for releasing stored display information and with the timing signal generator being coupled to the selection control circuit, coupled to the information control circuit, and coupled to an electrode drive circuit which is connected to the first common electrode for applying thereto a combined clock pulse signal with the control pulses for the supply of information to a display element, and with the pulses having the relevant polarities.

A further embodiment, having a simple reset and/or hold pulse generation, is characterized in that the control voltage source comprises a time-division multiplex circuit provided both in the coupling from the program generator and from the memory to the selection control circuit and to the information control circuit, respectively, with the time-division multiplex circuit being coupled to the timing signal generator for control thereby, and to the selection control circuit and to the information supply circuit for the supply of opposite logic values during occurrence of the pulses of the relevant polarities, for determining the polarity thereof.

Figure 1B:
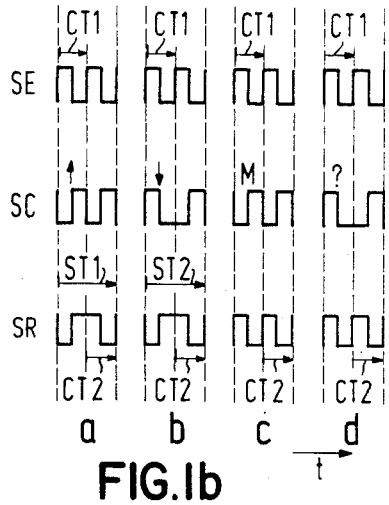
Figure 2:
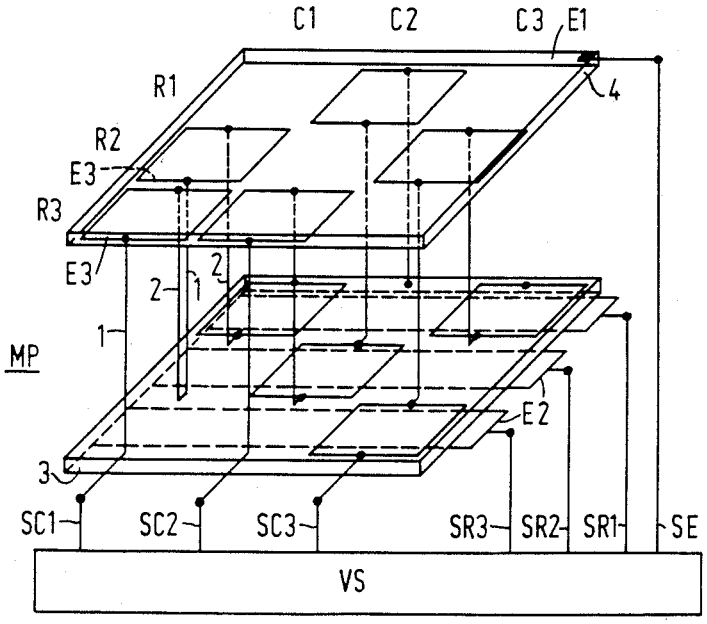
Figures 3A, 3B, 3C:
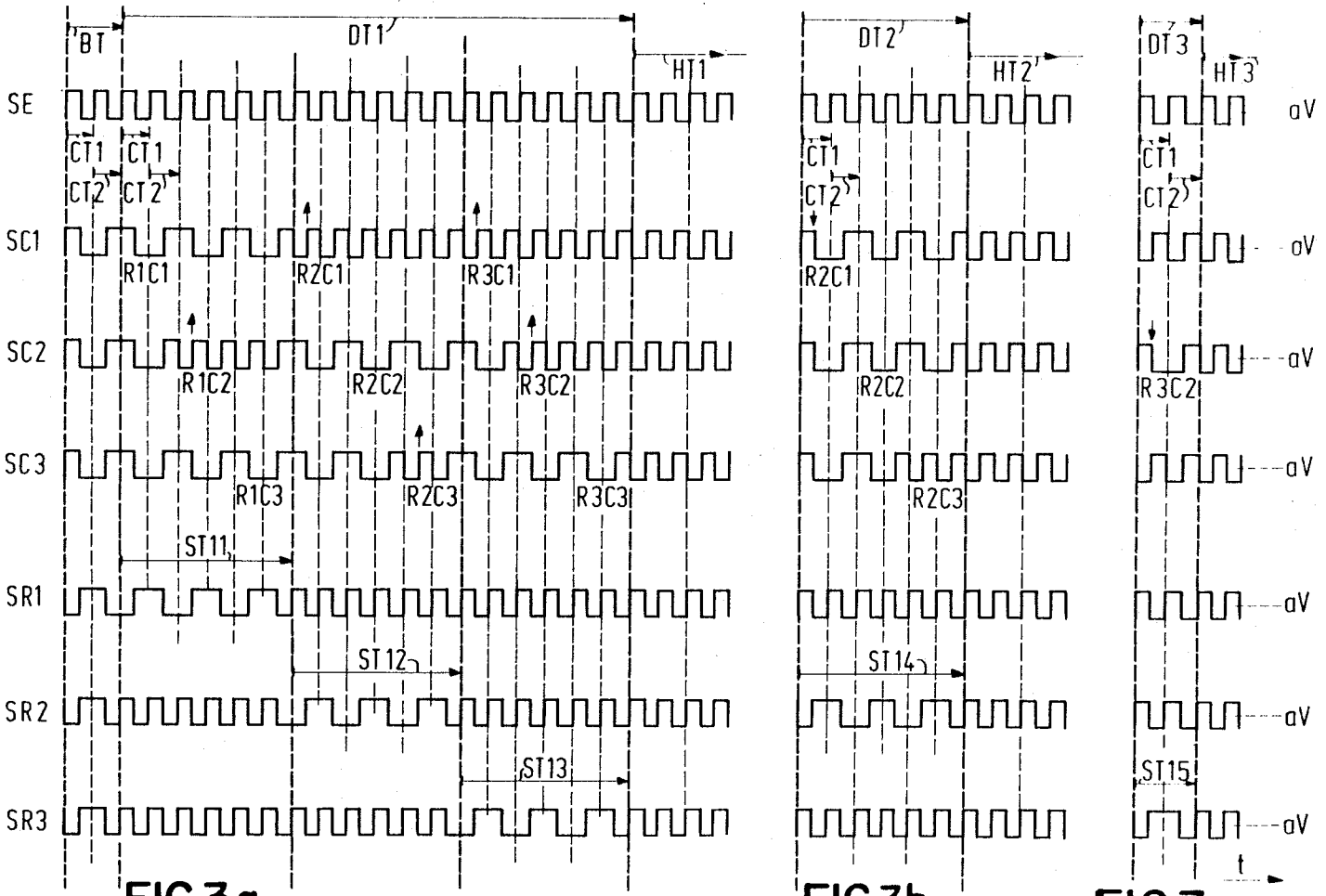
Figure 4:
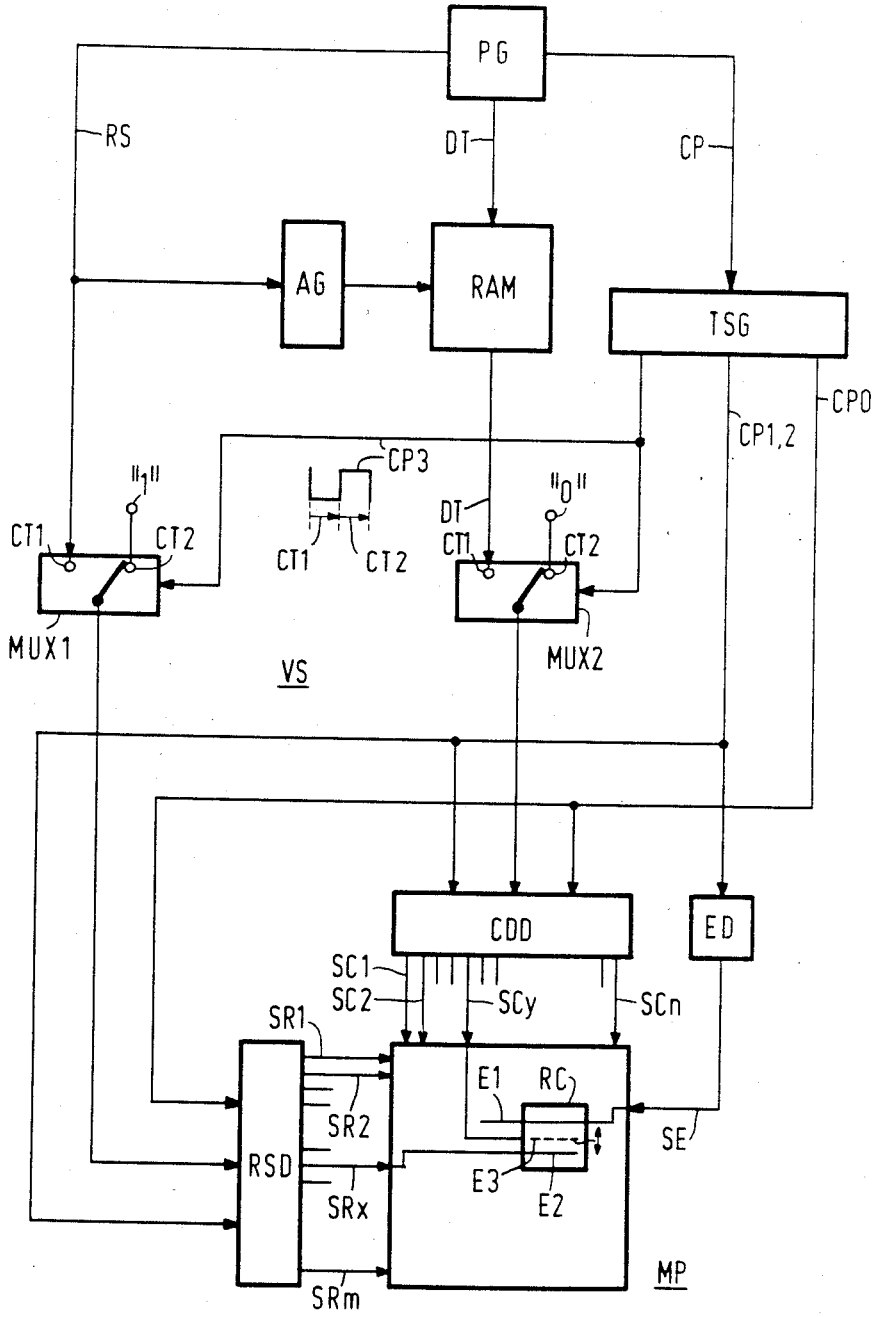

The invention will now be described in greater detail by way of example with reference to the accompanying drawing, wherein FIG. 1*a* schematically illustrates the structure of a picture display element and FIG. 1*b* schematically illustrates some associated control voltage diagrams as a function of time, FIG. 2 shows schematically an embodiment of an electroscopic picture display device assembled from the picture display elements of FIG. 1*a*, which are arranged in rows and columns, FIG. 3 shows by way of example some control voltage diagrams as a function of time, associated with an electroscopic picture display device of FIG. 2, which operates in accordance with the invention, and FIG. 4 illustrates block-schematically an example of an electroscopic picture display device according to the invention, comprising a suitable control voltage source.

FIG. 1*a* shows a picture display element RC which forms part of an electroscopic picture display device which is shown as part of an electroscopic picture display device which, as shown in FIG. 2, display elements R1C1, R1C2, R1C3, R2C1, R2C2 etc. to R3C3, inclusive, arranged in the form of a matrix in rows R1, R2 and R3 and in columns C1, C2 and C3. FIG. 2 shows, as a simple example, three rows and three columns of display elements RC. In FIG. 2 a display panel formed thus is denoted by MP with VS denoting a control voltage source for the panel MP. An electroscopic picture display device (MP, VS) is the result.

FIG. 1*a* shows that the element RC comprises first, second and third electrodes E1, E2 and E3, respectively. The first electrode E1 is a common electrode for all the elements RC. The second electrodes E2 forms part of a strip-shaped electrode which, as shown in FIG. 2, is located in the row direction. The fact that the electrodes E1 and E2 are part of a larger unit is denoted by means of broken lines. Each element RC has an individual third electrode E3. The electrode E3 is an intermediate electrode for the electrodes E1 and E2, and the electrode E3 is movable. In FIGS. 1*a* and 2 reference numerals 1 and 2 denote two electrically conducting, resilient connections by which the electrode E3 is connected to an insulating surface denoted by reference number 3 in FIG. 2. The resilient connections 1 and 2 form part of an electric through-connection in the column direction, which partly extends across the insulating surface 3. The strip-shaped electrodes E2 are provided at the other side of the insulating surface 3. In response to an appropriate supply of voltage to the electrodes E1, E2 and E3, the electrodes E3 can move to an insulating surface denoted in FIG. 2 by reference numeral 4, which surface is provided at the other side with an electrically conducting layer, not shown, which constitutes the common electrode E1. The electrode E1 and the surface 4 are transparent with the electrodes E3 having a reflecting surface on the side facing electrode E1. Let it be assumed that an opaque liquid is provided between the two surfaces 3 and 4 with a dark or a bright picture element being obtained on display because of absorption and reflection, respectively, of incident ambient light when the electrode E3 is located at the respective surfaces 3 and 4. By way of example, there now follows a description of the picture display device (MP, VS) of FIG. 2, which operates on the reflected light principle. In a known manner, light transmission could alternatively be used with equal advantage. In this situation liquids in which the electrode E3 is moved may be present. Instead of connecting the resilient connections 1 and 2 to the surface 3, they may alternatively be connected to the surface 4. This has the drawback that the transparent surface 4 must be provided with terminals, which must also be transparent, and this also applies to the resilient connections 1 and 2. In the embodiment shown in FIGS. 1*a* and 2 the resilient connections 1 and 2 are provided below the electrode E3, near the edge. Instead of the described resilient construction it is envisaged that the electrodes E3 may be clamped at one side with the opposite side being movable between the surfaces 3 and 4. In this case voltage can be applied by the clamps. Instead of a resilient construction or clamping, guided movement between, for example, electrically conducting rods provided between the surfaces 3 and 4 mmight alternatively be used. The specific construction of all this is not critical to the invention. The only important feature is the presence of the electrical through-connection between the electrodes E3, which is shown by way of example in the column direction which intersects with the direction of the through-connections of the second electrodes E2. Interchanging the row direction for the strip-electrodes E2 and the column direction for the movable electrodes E3 is a possibility. The electric through-connections for the third and second electrodes E3 and E2 in the column and row directions are shown by way of example. Constructions other than the straight pattern of the through-connections are possible, for example, using winding patterns. The construction of the electrode E1 as a common electrode is important. In this situation, as will be described hereinafter, picture interference may occur for which the present invention offers a solution.

To explain the drive of the elements RC, FIG. 1*b* shows some control voltage diagrams versus the time t, denoted by a, b, c and d. The common electrode E1 of FIG. 1*a* receives a control voltage SE. The electrodes E3 through-connected in the column direction are supplied with a control voltage SC, and the electrodes E2 located in the row direction are supplied with a control voltage SR. Two row selection periods are denoted for the control voltage SR at a and b of FIG. 1*b* by ST1 and ST2, respectively. The drawing shows that there are two clock pulse periods denoted by CT1 and CT2. The periods CT1 and CT2 have equal lengths in the drawing, but may be of unequal durations. The period CT2 may, for example, be a fraction of the period CT1. In addition to the cases a and b of FIG. 1*b* with the row-selection with periods ST1 and ST2, FIG. 1*b* further shows the two non-selection cases c and d with the control voltage SR.

In the first case a of FIG. 1*b* with the row selection period ST1, the polarity of the clock pulse having the period CT1 in the control voltages SR and SC are opposite to the polarity of the control voltage SE. This results in the electrode E3 at the selected row moving to the common electrode E1, provided it was not located there already, or is retained there, as the case may be. This is illustrated at the control voltage SC with an up-pointing arrow. The result is a bright picture element on display.

In the second case b of FIG. 1*b* with the row selection period ST2, the polarity of the clock pulse with the period CT1 in the control voltages SC and SE are opposite to the polarity of the control voltage SR. This results in the electrode E3 at the selected row moving to the strip-shaped electrode E2, provided it was not there already, or is retained there, as the case may be. At the control voltage SC this is denoted by a down-pointing arrow. The result is a dark picture element on display.

In the third and fourth non-selection cases c and d of FIG. 1*b* the polarities of the clock pulses with the period CT1 are the same for the control voltages SE and SR. On the column of electrodes E3 the polarity of the clock pulse with the period CT1, occurring in the control voltage SC, can now be opposite (c) or equal (d) to those in the control voltages SE and SR. The occurrence of the opposite polarity (case c) implies that elsewhere at the display panel MP in a selected row thereof, control voltages are present as shown in FIG. 1*b* for the duration ST1 and the period CT1. Put differently, the information associated with a bright picture element is present on the column of electrodes E3, both for the selected row(s) and for non-selected rows. This state (c) creates no problems for the non-selected column display elements RC with the information of a dark or a bright picture element. The relevant electrode E3 is then located near the strip-shaped electrode E2 or the common electrode E1 and is kept there by the opposite polarities of the clock pulses having the period CT1 in the control voltages SR, SC and SE, SC, respectively. The case c corresponds to a memory state at the elements RC which state is indicated in FIG. 1*b* by M at the control voltage SC.

If, as shown for the non-selection case d in FIG. 1*b*, equal polarities occur at the clock pulses having the period CT1 in the control voltages SE, SC and SR, problems are created. The information associated with a dark picture element is present on the column of electrodes E3, both for the selected row(s) and non-selected rows. The non-selected electrodes E3 of the column are then located at the associated strip electrode E2 (dark picture element) or at the common electrode E1 (bright picture element). In both cases there is no voltage difference between the near electrodes (E3, E2) and (E3, E1), which is referred to as a non-energized state. This non-energized state is illustrated in FIG. 1*b* by means of a (?) at the control voltage SC. During the non-energized state (?) the electrodes E3 of the near electrodes (E3, E1) and (E3, E2) will move to an equilibrium position. This non-energized state (?) is the result of the specific structure of the display panel MP with the common electrode E1 and the two intersecting sets of electrodes E2 and E3.

To counteract the consequence of non-energization at the near electrodes (E3, E1) or (E3, E2) in case d of FIG. 1*b*, each of the three electrodes E1, E2 and E3 of the display elements RC simultaneously receives, in accordance with the invention, a clock pulse having the period CT2 (FIG. 1*b*) with a polarity which is the same for the first and second electrodes E1 and E2, respectively and which is of the opposite polarity for the third electrode E3. Comparing the clock pulse with the period CT2 in the control voltage SE, SC and SR to the clock pulse with period CT1 contained therein, results in the clock pulse (CT2) being associated with the memory state M shown in FIG. 1*b*. The result is that in accordance with FIG. 1*b* each non-energized state (?) is followed by a reset with a memory state to the previous state. As shown in FIG. 1*b*, the reset information follows after each bright (↑) or dark picture element (↓) information supply and also in the event of non-selection of a display element RC on the column of which there is the information: picture element dark (M). Resetting is then superfluous as there was no previous non-energized state (?), but has no further consequences.

In FIG. 1*b* the clock pulses are shown having the same clock pulse period (CT1=CT2), phase and amplitude. Depending on the specific structure of the display elements RC it is alternatively possible to choose unequal amplitudes and clock pulse periods. Phase inversion may be an alternative choice with it following the phase-reversal of the control voltages SE, SC and SR during the period CT2 such that the clock pulse frequency of the control voltage SE is reduced to half the frequency.

Instead of a reset information with the clock pulse (CT2) after each clock pulse (CT1), it is envisaged that a reset information may be spaced in time, after a number of clock pulses (CT1). The permissible time difference between non-energization and the reset with the memory state then depends on the specific structure of the display elements RC. The reset instant must namely occur before the disturbance in the displayed information becomes noticeable, which depends on the rate of travel of the electrode E3 during non-energization. Always using the clock pulse (CT2) following after the clock pulse (CT1) has the advantage that the time difference no longer depends on the specific structure of the display element RC. The clock pulse period CT2 may then be a fraction of the clock pulse period CT1, if brief supply of information is desired.

For the matrix panel MP shown in FIG. 2 as having three rows and three columns of display elements RC, FIG. 3 shows by way of example some control voltage diagrams as a function of the time t. The control voltage SE is applied to the common electrode E1, while three row and column drive voltages are denoted by SR1, SR2, SR3 and SC1, SC2, SC3, respectively. For the control voltages SE, SC and SR of FIG. 3 a voltage aV is shown with a then symmetrical clock pulse voltage. The voltage of aV is, for example, equal to zero Volts or is a d.c. or a.c. voltage. FIG. 2 shows by way of example an information pattern on display. The structure of this information pattern is based on a starting state in which the matrix panel MP is completely dark. Thereafter the information to be displayed is applied with a row selection at the strip-shaped bottom electrodes E2 and a supply of information at the movable intermediate electrode E3 with the column through-connection. In this sequential row selection, the supply of information per row can be effected simultaneously or sequentially with FIG. 3 showing, by way of example, control voltage diagrams for a sequential supply. After the information pattern shown in FIG. 2 has been fed-in (case a in FIG. 3), FIG. 3 illustrates a change in information with a row selection and a sequential information supply (case b) and thereafter a change in information with directly a predetermined picture element selection- and -information supply (case c).

FIG. 2 shows that the information pattern contains dark picture elements at the display elements R1C1, R1C3, R2C2, and R3C3. Bright picture elements are displayed by the display elements R1C2, R2C1, R2C3, R3C1 and R3C2. This information pattern is obtained in an information supply period indicated by DT1 in FIG. 3. Preceding this period there is, in the above-described manner, an information erase period BT. During erase BT, all the electrodes E3 are moved during the clock pulse (CT1) to near the electrodes E2 if they were not already present there, as the clock pulse (CT1) has the same polarity in the control voltages SE and SC1, SC2 and SC3 and the opposite polarity in the control voltages SR1, SR2 and SR3. The subsequent clock pulse (CT2) in the erase period BT has, as described in the foregoing, no influence on the matrix panel MP.

Thereafter, during the information supply period DT1, a row selection period ST11 is present at the first row R1 of the display elements R1C1, R1C2 and R1C3, as shown in the control diagram SR1 of FIG. 3. The display elements R1C1 and R1C3 occur as dark picture elements, while the display element R1C2 with the up-pointing arrow occurs as a bright picture element. Considered two-dimensionally, the control diagrams shown in FIG. 3 follow from the control diagrams of FIG. 1*b*.

The row-selection period ST11 is followed by a row selection period ST12 at the second row R2 of display elements RC. From the polarities, shown in the drawing, of the clock pulses (CT1) at the control voltages SC1, SC2 and SC3 relative to the other control voltages, the bright picture elements (R2C1 and R2C3) and the dark picture element (R2C2) follow. Thereafter, in a row selection period ST13, the selection of the third row is effected with the aid of the control diagram SR3. Bright picture elements (R3C1 and R3C2) and a dark picture element (R3C3) follow. In the case of a simultaneous supply of information, the shown row selection periods ST and consequently the information supply period DT1 can be reduced to a fraction thereof, which fraction depends on the number of display elements RC per row (inversely proportional).

FIG. 3 shows that the information supply period DT1 is followed by an information hold period HT1. The clock pulses in the control voltages SE, SR1, SR2 and SR3 then have the same polarities, while the clock pulses in the control voltages SC1, SC2 and SC3 have opposite polarities. This has for its result that with the associated memory state M the stored information pattern of FIG. 2 remains present without any change, since the electrodes E3 continue to be subjected to the prevailing force of attraction of the electrodes E1 or E2 to which they are nearest. During the period HT1 the clock pulses may have an amplitude smaller than the amplitude shown. The same applies to the clock pulse frequency.

The case b of FIG. 3 is shown in the drawing with an information supply period DT2 with a selection of the row R2 during a period ST14 and with a supply of information which is assumed to be sequential. Comparing the control voltages SC1, SC2 and SC3 during the row selection periods ST12 and ST14 shows that the control voltages SC2 and SC3 are repeated and the control voltage SC1 deviates. An arrow at the control voltages SC1 indicates that the selected display element R2C1 receives the information for a dark picture element, while previous to that, in accordance with the case a of FIG. 3, a bright picture element is present. This information for a dark picture element on the first column C1 of display elements R1C1, R2C1 and R3C1 (FIG. 2) may cause problems for the dark picture element of the display element R1C1 and for the bright picture element of the display element R3C1. The non-energized state (?) of FIG. 1*b* occurs at both display elements R1C1 and R3C1, since comparing the control voltages SE, SC1, SR1 and SR3 for the first clock pulse period CT1 for the case b illustrated in FIG. 3 to the control voltages SE, SC and SR for the clock pulse period CT1 in the case d illustrated in FIG. 1*b* show that they are the same. In the described manner the non-energized state is followed in the subsequent clock pulse period CT2 by the reset operation with the memory state. In accordance with case b of FIG. 3 an information hold period HT2 follows the information supply period DT2.

In FIG. 3 a single picture element selection and information supply is shown for the case c. The selection period is denoted by ST15 at the control voltage SR3 for the third row R3 of the display element R3C1, R3C2 and R3C3 of FIG. 2. At the control voltage SC2 it is indicated that the bright picture element at the display element R3C2 receives the information for a dark picture element. The information for the dark picture element on the second column C2 of display elements R1C2, R2C2 and R3C2 results in the non-energizing problem at the dark display element R2C2 and the bright display element R1C2. For a voltage comparison, reference is made to the clock pulse period CT1 at the control voltages SE, SC2, SR1 and SR2 of the case c of FIG. 3 and to the control voltages SE, SC and SR of the case d of FIG. 1*b*. Also here the non-energized state is followed by the clock pulse (CT2) for the reset operation with the memory state. In FIG. 3 it is shown for the case c that the information supply period DT3 is followed by an information hold period HT3.

FIG. 4 shows block-schematically an embodiment of an electroscopic picture display device (MP, VS) which comprises a control voltage source VS suitable for use with a row selection and a column information supply in the matrix panel MP. Interchanging the row and column connections results in a column selection and a row information supply. In FIG. 4 it is shown at a display element RC of the matrix panel MP that the rows with the bottom electrode E2 and the columns with the intermediate movable electrode E3 are connected in the way as described with reference to the FIGS. 1*a*, 2 and 3. Also here it is possible to interchange the connections.

In FIG. 4, reference PG denotes a program generator whose outputs are coupled to inputs of a random-access memory RAM, a timing signal generator TSG, an address generator AG and a multiplexer MUX1. For the sake of simplicity, the outputs and intputs and the coupling are shown as being single, but in practice they may be multiple. The program generator PG applies to the memory RAM with separate memory locations, which memory is addressable via the generator AG, display information DT for storage in the memory locations corresponding to the display elements RC in the matrix panel MP. The memory RAM then contains, for example, a pattern of logic "0" and "1", which corresponds to a dark and bright display element RC, respectively. The timing signal generator TSG receives, by way of example, clock pulse information and under the control thereof produces a high-frequency clock pulse signal CPO, a combined clock pulse signal CP1,2 and a change-over clock pulse signal CP3. Row selection information RS is applied to the multiplexer MUX1 for conveyance to a display element or a row selection control circuit RSD associated with the matrix panel MP. To effect the described supply of information, the program generator PG may comprise a microcomputer or a microprocessor and the supply of information may be either sequentially or simultaneously, depending on the requirements. Information feed-in equipment, such as, for example, a keyboard may be provided at the generator PG and/or the memory RAM.

A single or multiple output of the memory RAM for retrieval of stored display information is coupled via a multiplexer MUX2 to a display element or column information control circuit CDD associated with the matrix panel MP. The multiplexers MUX1 and MUX2 together form a time-division multiplex circuit (MUX1, MUX2), which is thus present in the coupling of the program generator PG and of the memory RAM to the selection control circuit RSD and the information control circuit CDD, respectively. The change-over clock pulse signal CP3 shown in FIG. 4 as a function of time is applied to the time-division multiplex circuit (MUX1, MUX2) for its control. The signal CP3 has a clock pulse period with a first period portion CT1 and a second period portion CT2. These period portions correspond to the clock pulse periods CT1 and CT2 shown in FIG. 1*b* and FIG. 3. Next to the multiplexers MUX1 and MUX2 the drawing shows change-over contacts denoted by CT1 and CT2 to indicate that these input contacts are through-connected to the output during the time period corresponding therewith. The contact CT1 of the respective multiplexers MUX1 and MUX2 receives the row selection information RS from the program generator PG and the display information DT from the memory RAM, respectively. The contact CT2 of the multiplexer MUX1 is connected to a terminal which carries a voltage corresponding to a logic "1". The contact CT2 of the multiplexer MUX2 is connected to a terminal carrying a voltage corresponding to a logic "0". This results in selection information and display information being conveyed by the contacts CT1 of the time-division multiplex circuit (MUX1, MUX2) and logic values being conveyed by the contacts CT2.

The high-frequency clock pulse signal CPO is applied, for shifting and processing information, to the control circuits CDD and RSD, which in addition receive the combined clock pulse signal CP1,2. The signal CP1,2 is further applied to an electrode drive circuit ED whose output is connected to the common electrode E1 of the matrix panel MP. The circuit ED produces the control voltage SE shown in FIGS. 1*b* and 3. with which the combined clock pulse signal CP1,2 corresponds. The circuit RSD produces the likewise shown control voltages SR1, SR2, . . . SRx . . . SRm for the row selection when the matrix panel MP comprises m rows of display elements RC. In this situation, the circuit CDD produces control voltages SC1, SC2, . . . SCy . . . SCn for the supply of information when the matrix panel MP comprises n columns of display elements RC. FIG. 4 shows that the display element RC is present at the intersection of the row connection to the control voltage SRx and the column connection with the control voltage SCy.

The mode of operation of the arrangement (MP, VS) as shown in FIG. 4 will be described with reference to the voltage diagrams shown in FIGS. 1*b* and 3. Starting from the assumption that the matrix MP is completely dark, the program generaor PG will, when it is filled with information from the memory RAM, cause this information to become available for display on the matrix panel MP. In the consecutive row selections by means of the circuit RSD the display information can be supplied sequentially (FIG. 3, period DT1) or simultaneously by the circuit CDD. An information hold period (HT1, FIG. 3) occurs after the supply of information. During this period the control voltages SC are in anti-phase with the control voltages SR (and the control voltage SE), for which reference is made to FIG. 3, the hold period HT1 and FIG. 1*b*, case c. This anti-phase is obtained at the control voltage source VS of FIG. 4 by the opposite logic values "0" and "1". Let it be assumed that during the hold periods the position shown in FIG. 4 of the multiplex circuit (MUX1, MUX2) is continuously present with the logic "0" at the control circuit CDD causing the clock pulse signal CP1,2 to be inverted and the logic "1" at the control circuit RSD not affecting the polarity of the clock pulse signal CP1,2. Acting thus, the memory state M of FIG. 1*b*, case c, is present in a simple way during the hold period.

In a comparable manner the logic "0" and "1" are present at the respective control circuits CDD and RSD during the information supply period DT during the periods CT2, so that here also the clock pulses are inverted. This clock pulse inversion results in the reset with the memory state.

Instead of the described simple reset and hold pulse generation by means of the time-division multiplex circuit (MUX1, MUX2) and the logic values "0" and "1", a structure of the program generator PG with a program in which this pulse generation is directly laid down may be adopted.

For a picture element-selective information supply under the control of the program generator PG it is stated that this operation can be effected with selection of the relevant row by means of the control circuit RSD and the associated information supply by the control circuit CDD, and in this situation information which cannot be changed in the row is repeated and further the changed information is applied for the first time.

What is claimed is:

1. An electroscopic picture display device comprising a matrix of display elements, each of said display elements including first and second fixed electrodes separated by a distance, and a third intermediate electrode movable between said first and second electrodes, said first electrode being common to all display elements of said matrix, said second electrodes of said display elements extending in a direction which intersects another direction in which said third electrodes of said display elements extend; and control voltage means for applying control pulses to said electrodes at least during an information signal supply period, said third electrodes being located near one of said first electrode or said second electrodes after said information signal supply period depending on polarity of said control pulses at said third electrodes relative to polarities of said control pulses at said first and second electrodes, said polarities of said control pulses at said first and second electrodes being in anti-phase, said control voltage means in addition to said information signals also supplying simultaneously to each of said three electrodes a pulse of one polarity to said first and second electrodes and a pulse of an opposite polarity to said third electrodes during said information supply period.

2. An electroscopic picture display device according to claim 1, wherein during said information supply period said control voltage means applies said pulses of opposite polarities to first, second, and third electrodes of a display element after said control pulse for information supply.

3. An electroscopic picture display device according to claim 1 or claim 2, wherein said control voltage means includes a program generator, an addressable memory with separate memory locations coupled to said program generator, an address generator coupled to said program generator for addressing said memory, a timing signal generator coupled to said program generator, display element selection control circuit means connected to said matrix of display elements for applying pulses to said matrix, display element information control circuit means coupled to an output of said memory for releasing stored display information to said matrix, said timing signal generator being respectively coupled to said selection control circuit means, to said information control circuit means, and to an electrode drive circuit means, said electrode drive circuit means being connected to said first electrode for applying a combined clock pulse signal to said first electrode upon supplying said information signals to a display element and upon supplying said pulses of said one polarity and said opposite polarity to said display element.

4. An electroscopic picture display device according to claim 3, wherein said control voltage means further includes time-division multiplex circuit means coupled between said program generator and said selection control circuit means and coupled between said memory and said information control circuit means for supplying opposite logic values during occurrence of said pulses to determine polarity of said pulses, said timing signal generator controlling said time-division multiplex circuit means.

* * * * *